US006311788B1

(12) United States Patent
Weixler

(10) Patent No.: US 6,311,788 B1
(45) Date of Patent: Nov. 6, 2001

(54) MAGAZINE AND MANIPULATING APPARATUS FOR DRILLING ROD PARTS

(75) Inventor: Leonhard Weixler, Thierhaupten (DE)

(73) Assignee: Bauer Spezialtiefbau GmbH, Schrobenhausen (DE)

( * ) Notice: Subject to any disclaimer, the term of this patent is extended or adjusted under 35 U.S.C. 154(b) by 0 days.

(21) Appl. No.: 09/400,194

(22) Filed: Sep. 21, 1999

(30) Foreign Application Priority Data

Sep. 21, 1998 (DE) ..... 198 43 167

(51) Int. Cl.[7] ..... E21B 19/20

(52) U.S. Cl. ..... 175/52; 175/85; 166/77.51; 414/22.53; 414/22.62

(58) Field of Search ..... 175/52, 85; 166/77.51; 414/22.51–22.53, 22.62

(56) References Cited

U.S. PATENT DOCUMENTS 3,701,435 * 10/1972 Woolslayer et al. .
4,604,724 * 8/1986 Shaginian et al. .
5,607,280 * 3/1997 Rozendaal .
5,806,613 * 9/1998 Sparks et al. .

FOREIGN PATENT DOCUMENTS 2129701 1/1972 (DE) .
2533621 C2 2/1977 (DE) .
2721342 A1 11/1978 (DE) .
3108053 C2 9/1982 (DE) .

* cited by examiner

*Primary Examiner*—Roger Schoeppel
(74) *Attorney, Agent, or Firm*—Pepper Hamilton LLP

(57) ABSTRACT

The invention relates to a magazine and manipulation apparatus for drilling rod parts for a drill, having a rod magazine in which the drilling rod parts are received in a multi-layered arrangement in a store, and having a removal device for transferring the individual drilling rod parts from the rod magazine into a charging device which transports the drilling rod part to the drill and for returning the drilling rod parts from the charging device to the rod magazine. In this apparatus, the removal device is movably guided vertically and relative to the rod magazine on a guide and possesses a pivot mechanism having at least one gripping unit for the pick-up of a drilling rod part and by pivoting of the pivot mechanism, the drilling rod part retained in the gripping unit is moved between the position of transfer in the rod magazine and the charging device, and in which, by a vertical displacement of the removal device, the pivot mechanism with the gripping unit is adapted to the current, position-dependent position of transfer in the rod magazine and to the charging device.

14 Claims, 3 Drawing Sheets

MAGAZINE AND MANIPULATING APPARATUS FOR DRILLING ROD PARTS

RELATED APPLICATIONS

This application claims priority to German Patent Application Number 19843167.8 filed Sep. 21, 1998 which is incorporated herein by reference.

FIELD OF THE INVENTION

The invention relates to a magazine and manipulation apparatus for drilling rod parts for a drill, having a rod magazine in which the drilling rod parts are received in a multi-layered arrangement in a store, and having a removal device for transferring the individual drilling rod parts from the rod magazine into a charging device which transports the drilling rod part to the drill and for returning the drilling rod parts from the charging device to the rod magazine.

Such magazine and manipulating apparatuses are used, for example, to remove the individual drilling rod parts from an appropriately sized rod magazine and feed them to a drill of a well-drilling system for deep drilling to the depth of, for example, several hundred meters.

BACKGROUND OF THE INVENTION

DE-OS 27 21 342 has disclosed a magazine and manipulation device for drilling rod parts which possesses a manipulator designed as a rod trolley by means of which the tubular drilling rod parts or rod sections are removed from a separate rod magazine, which is set up adjacent to the rod trolley and in which they are received in the plurality of layers, and can be returned thereto. The manipulator contains a removal device which possesses two extensible arms arranged parallel to each other and at a distance apart and capable of pivoting about a longitudinal axis of the rod trolley, and transfer members rotatably mounted on the arms. In order to remove a rod section, the entire rod magazine is lifted until the currently uppermost layer of the rod sections is arranged slightly above the arms, which are then moved out in a position inclined upward from their pivot axis below the uppermost layer of the rod magazine. After the lowering of the lateral limiting posts of the rod magazine, the latter is positioned obliquely so that the rod sections roll out from the rod magazine and over the inclined arms as far as the transfer member. The transfer member is designed as a disk having a recess for a rod section. The transfer member, which is driven in rotation, can, in the course of each rotation, receive a rod section in the arm and bring it via a semicircular path into the center of the manipulator and into a position of readiness for further manipulation. Since, however, the recess in the transfer member leaves a large amount of play for the rod section in the circumferential direction, the latter, when turned over, falls without retention or guidance into the position of readiness on the manipulator. When rod sections are bent in operation, this may result in their falling to the ground instead of into the position of readiness and thus constituting an accident risk for the operating personnel. In addition, the basic structure of the rod magazine has to be of very strong design, since it has to be moved via correspondingly long hydraulic cylinders as far as the removal point of the rod sections in the topmost position. Other devices are known from DE 3108053 C2 and DE-C 2129701.

SUMMARY OF THE INVENTION

The object of the invention is to provide an apparatus of the type indicated initially in which the drilling rod parts or rod sections are securely guided when turned over and the rod magazine is of simple construction and retains its stability even during the turning-over of the drilling rod parts. This object is achieved, according to the invention, in that, in the apparatus referred to initially, the removal device is movably guided vertically and relative to the rod magazine on a guide and possesses a pivot mechanism having at least one gripping unit for the pick-up of a drilling rod part and by pivoting of the pivot mechanism, the drilling rod part retained in the gripping unit is moved between the position of transfer in the rod magazine and the charging device, and in which, by a vertical displacement of the removal device, the pivot mechanism with the gripping unit is adapted to the current, position-dependent position of transfer in the rod magazine and to the charging device.

This design of the apparatus according to the invention guarantees that a given drilling rod part is transferred securely from the store into the charging device, and also in the opposite direction, since it is continuously retained until it arrives at its respective target position, as a result of which any risk of accident caused by a drilling rod part falling to the ground is excluded. Moreover, the stability of the entire apparatus is improved, since in order to remove a drilling rod part it is not necessary to lift the whole rod magazine for vertical adjustment but merely to move this one drilling rod part with the removal apparatus upward. The rod magazine is therefore of simple construction and can thus be integrated into a drill trolley.

Advantageous embodiments of the invention are indicated in the subclaims.

Expediently, the rod magazine possesses a frame with vertical posts defining the store and one of the posts contains the vertical guide for the removal device. The number of frames, set at a distance apart in the longitudinal direction, and hence the number of posts is derived from the length of the drilling rod parts and the support thus required. One of these posts, especially one of the posts arranged centrally on the side wall of the rod magazine, may thus possess the vertical guide for the removal device. However, the guide may also be attached to another component in the region of the rod magazine, and it may also diverge from the vertical alignment provided that it ensures the necessary vertical adjustability and vertical adaptation of the removal device, retaining its correct positioning in the positions of transfer. The removal device may possess a drive motor or other drive assigned directly to it, which may also be responsible for the actuation of the pivot mechanism.

For the operation of the apparatus according to the invention, it is particularly advantageous if by means of a movement device a drilling rod part mounted in the store can be brought into its position of transfer and out of that position of transfer into a release position in the store. This ensures that the drilling rod part is moved and positioned correctly for its destination and that the position of transfer for the filling of the store is cleared after each introduction of a drilling rod part and free for the next drilling rod part. Such a movement device may, for example, displace a drilling rod part accordingly by direct action of force by means of a movement arm or the like.

In another advantageous embodiment, the movement device possesses a pivotable support for a lower layer of the drilling rod parts which is arranged at the bottom of the frame and mounted to pivot about a longitudinal axis of the rod magazine. Thus, in a simple manner, the action of gravity on the drilling rod parts arranged on an obliquely positioned plane can be used for the desired movement of the drilling rod parts. An oblique position of the bottom layer is transferred to the layers above it without the whole rod magazine being tilted thereby about a pivot axis. Stability is thus still preserved even when the store is full.

As a result of the fact that, in an expedient embodiment, each drilling rod part, in its position of transfer, rests on one of the posts adjacent to the removal device, a permanently defined position of transfer is achieved in the vicinity of the removal device, by means of which short transfer paths are achieved.

Expediently, the posts possess vertical grooves for guidance of spacer beams which are inserted between the layers of the drilling rod parts. This guidance or comparable guidance of the spacer beams permits the inclination of all the drilling rod parts in the store to be set in a simple manner.

Preferably, the pivotable support can be pivoted by a pivot device both in a horizontal orientation and in both pivoting directions, so that the necessary inclination settings can be set. This also results in favorable positioning of the center of gravity.

The pivot device may possess at least one pressure medium cylinder which is arranged between the frame and the pivotable support. However, other actuating means, such as mechanical adjustment devices, may also be used.

The gripping unit is designed as a gripping claw expediently for picking up drilling rod parts of different diameters, which is attached to an arm of the pivot mechanism that can be pivoted about a longitudinal axis.

In a preferred embodiment, the gripping claw has an upper and a lower claw part, at least one of the claw parts being pivotably mounted on the arm of the pivot mechanism. The pivotable mounting of the claw part contains a pin, whose position is adjustable so that the claw parts, in their gripping and closed position, can securely retain drilling rod parts of different diameters.

The pivotable mounting of the claw part may possess an eccentric mechanism for setting the position of the pivotable claw part, by means of which the pin can be adjusted between two or more positions. Expediently, the positions set may be locked by means of a clamping device. Instead of an eccentric mechanism, other adjustment devices for the pin may be provided such as, for example, a linear displacement unit or the like.

The pivot mechanism of the removal device may possess at least two gripping units which are spaced in the longitudinal direction, the number of gripping units in a longitudinally spaced arrangement being capable of being varied as a function of the length of the drilling rod parts in order to guarantee secure gripping, for example at both ends of a drilling rod part or additionally in the middle part.

Expediently, the apparatus according to the invention is attached to a rod trolley, which may also be designed as a drill trolley with a drill.

BRIEF DESCRIPTION OF PREFERRED

The invention is described in detail below with reference to an example of embodiment of a magazine and manipulating apparatus according to the invention, with reference to drawings, in which:

FIG. 1: shows an end-on view of a magazine and manipulating apparatus according to the invention;

DETAILED DESCRIPTION OF PREFERRED

Figure 2:
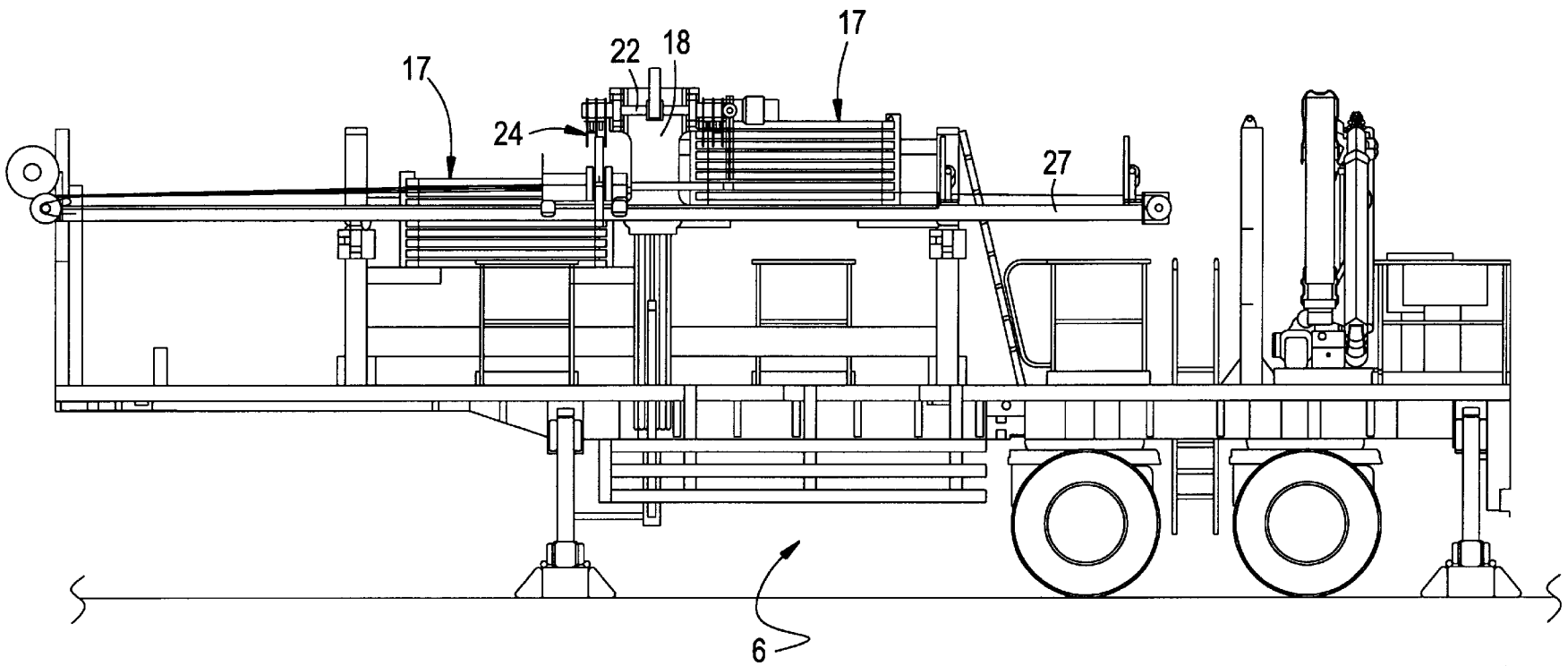
FIG. 2 shows a lateral view of a drill and rod trolley for the magazine and manipulating apparatus according to the invention.

An example of embodiment of the magazine and manipulating apparatus according to the invention contains a rod magazine 1 for receiving rod sections or drilling rod parts 2, such as pipes, rods or the like, which after removal from the rod magazine 1 can be screwed together in a known manner and form a drilling rod. The rod magazine 1 possesses a frame 3 having a lower transverse frame part 4 and two lateral, mutually opposite vertical rungs or posts 5. For the secure retention of relatively long drilling rod parts 2, two or more of these frames 3 with vertical posts 5 at a distance apart in the longitudinal direction of the drilling rod parts 2 are provided and fixedly connected to each other by a longitudinal frame. The rod magazine 1 is arranged, for example, on a rod trolley 6 which may also be designed as a drill trolley carrying a drilling machine (see FIG. 2, which however, does not show a drilling machine or drilling rod parts).

Figure 1:
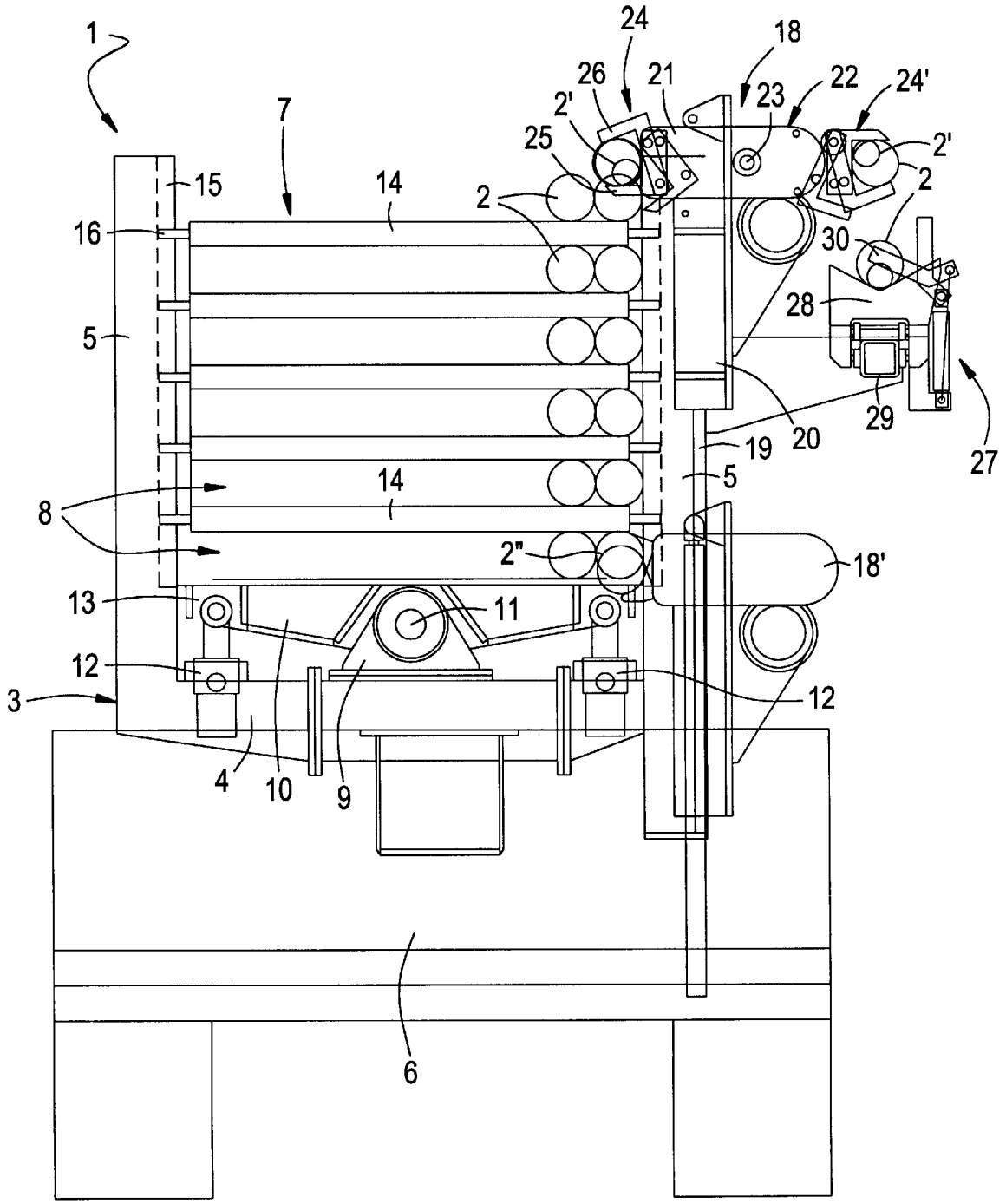

By means of the one or more frames 3, a store 7 of the rod magazine 1 is defined in which the individual drilling rod parts 2 can be received in a plurality of layers 8 (for example, six layers according to FIG. 1, FIG. 1 showing only two drilling rod parts in each layer for reasons of simpler representation and two arrows provided with the reference numeral 8 pointing to the two lower layers). On the lower transverse frame part 4 of the frame 3, bearing block 9 is arranged approximately centrally between the posts 5 and retains a pivotable support 10 in an arrangement pivotable about a longitudinal axis 11. By means of a pivot device with two pressure medium cylinders 12, e.g. hydraulic cylinders, which are supported between the two opposite end regions 13 and the transverse support 4 of the frame 3, the pivotable support 10 on which the drilling rod parts 2 in the bottom layer 8 are laid, can be moved out of its generally horizontal position (see illustration in FIG. 1) into inclined positions in both pivoting directions. With a multi-layered filling of the stores 7, a spacer beam 14 is laid, on each frame 3, on the drilling rod parts 2 of each completely filled layer 8. To this end, the two posts 5 of a frame 3 possess guide devices, such as, for example, interior, mutually facing vertical grooves 15, so that the spacer beams 14, which are inserted into these grooves 15 from above by bearing pins 16 formed at their ends, are guided by the grooves 15 but are freely displaceable vertically. The spacer beams 14 are received, when not in use, for example, in two magazines 17 (see FIG. 2) on the drill trolley 6.

The apparatus according to the invention further contains a removal device 18, whereby the drilling rod parts 2 can be removed individually from the rod magazine 1 and/or the store 7 and restored therein. The removal device 18 is arranged approximately centrally on a long side of the rod magazine 1 and mounted on a guide 19, with the possibility of vertical displacement. To this end, the guide 19 is provided, for example, as a vertical longitudinal guide on a separate lateral support or, expediently, on one of the posts 5 of the rod magazine 1. An arm 21 of the pivot mechanism 22 is pivotably mounted on a base body 20, displaceable on the guide 19, of the removal device 18 about a longitudinally oriented pivot axis 23 and movable by a drive. The arm 21 possesses a gripping and clamping unit with, for example, a gripping claw 24 having two diagrammatically illustrated, movable claw parts 25 and 26 which, as a result of their design, for example as angled parts or the like, can fixedly and securely grip drilling rod parts 2 of different diameters.

This possibility is shown in FIG. 1 by the small-diameter circles 2' drawn on the gripping claws 24 and corresponding to such drilling rod parts 2 or pipes. Furthermore, FIG. 1 shows the arm 21 with the drilling claw 24 in the inner pivot position, in which the gripping claw 24 engages into the store 7, and additionally shows the gripping claw 24 in a second position (designated 24') which it has adopted after the pivoting of the arm 21 into its outer pivot position.

A charging device 27 is arranged laterally next to the rod magazine 1 and oriented parallel thereto. It possesses a bearing unit 28 with a recess which is arranged approximately vertically below a drilling rod part 2 retained in the second position of the gripping claw 24'. The bearing unit 28 is mounted on a guide tube 29 and is displaceable along the rod magazine 1. A drilling rod part 2 lying in the recess of the bearing unit 28 can be fixedly clamped thereto by a pivotable depressor 30 and thus displaced with the bearing unit 28 of the charging unit 27.

An example of the way in which the apparatus according to the invention operates is described below. In order to remove one of the drilling rod parts 2 from the store 7 of the rod magazine 1, the pivotable supportable 10 is pivoted to the right (in other words clockwise about the pivot axis 11 according to FIG. 1) by the pressure medium cylinder 12, so that its upper bearing surface is slightly inclined downward to the right toward the removal device 18. The drilling rod part or parts 2 lying thereon in the currently uppermost layer 8, which are not covered by any additional layer, thereupon roll to the right until the first, leading drilling rod part 2 rests against the right-hand post 5. This guarantees that the drilling rod part 2, in a defined position of transfer, rests against the right-hand post 5, a position of transfer being defined as a right-hand post 5 for each of the superposed layers 8. The position of a drilling rod part 2 arranged in the position of transfer is shown, for example, by the circle with the reference FIG. 2" drawn in the lower layer 8 (in this case, the removal device 18 will adopt a lower position, designated by the reference FIG. 18', and the spacer beams 14 and drilling rod parts 2 drawn in above it would have already have been removed for the removal of this drilling rod part 2). Because of the bearing pins 16 of the spacer beams 14, which are freely movable vertically in the grooves 15, the pivoting of the pivoting beam 10 is transmitted from the drilling rod parts 2 of the lower layer 8, arranged at an angle, to all spacer beams 14 lying above them and additional layers 8 as far as the uppermost layer 8. This ensures that, when the pivotable support 10 is pivoted, each drilling rod part 2 can always attain its position of transfer.

In order to grasp the drilling rod part 2 arranged in the position of transfer, the removal device 18 is moved vertically to a height assigned to the position of transfer. The lower claw part 25 is extended or pivoted from a retracted position under the drilling rod part 2, the upper claw part 26 grasps the drilling rod part 2 from above, so that it is thus fixedly retained in the gripping claw 24. While the removal device 18 is then moved upward, the pivotable support 10 is at the same time pivoted back into its horizontal alignment. As a result, the compressive force exerted by the next drilling rod part or parts 2 against the drilling rod part 2 to be removed at the post 5 ceases, so that its removal is no longer obstructed. The removal device 18 moves into its upper removal or pivot position (see upper illustration in FIG. 1), in which the arm 21 of the pivot mechanism 22 is pivoted outward through about 180° together with the retained drilling rod part 2. The removal device 18 is then lowered until the drilling rod part 2 is laid in the recess of the bearing unit 28, where it is released by the gripping claw 24 and fixed by the depressor 30. By means of the charging device 27, the drilling rod part 2 is moved lengthwise to a transfer station in which the drilling rod part 2 is brought into a perpendicular position in order to be screwed to the drilling train already in position. In the case of well drills, the drilling head (not shown), attached to a mast, can be rotated and pivoted so that the horizontally fed drilling rod part 2 pivots with the drilling head and can thus be attached in a simple manner to the drilling train. The operation described is repeated as many times as required by the number of drilling rod parts 2.

When the drilling train is withdrawn, the operation proceeds in exactly the reverse manner. When a drilling rod part 2 is lowered into the position of transfer of the store 7, however, the pivotable support 10 is pivoted to the left, so that a drilling rod part 2 already laid in the corresponding position rolls toward the left-hand post 5, remote from the removal device 18, and thus does not occupy the position of transfer.

Figure 3:
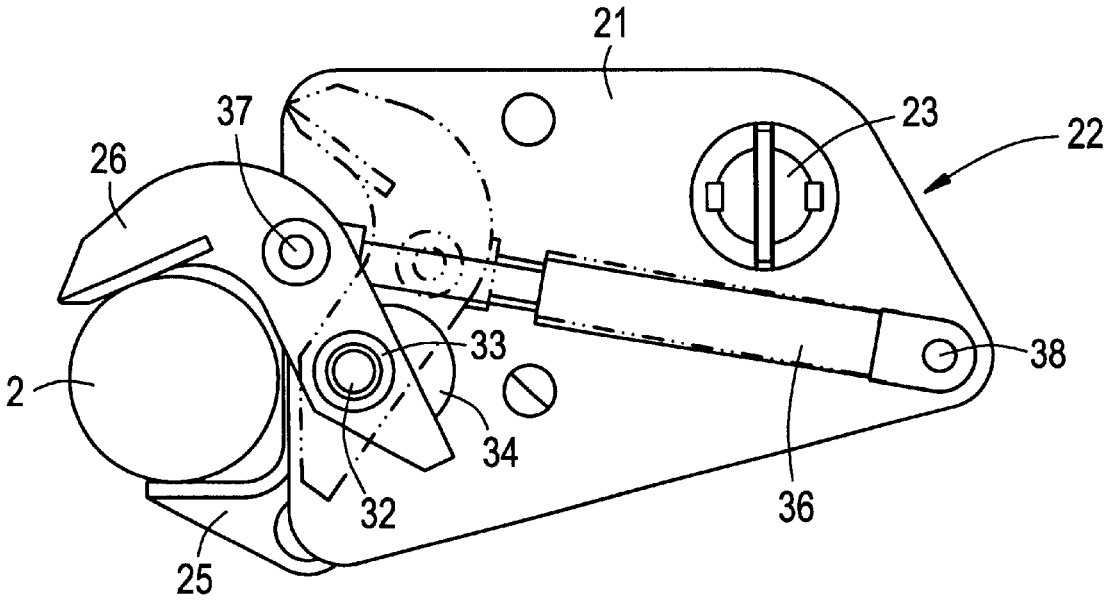
FIG. 3 shows an enlarged view, by comparison with FIG. 1, of a removal device having a claw part of a gripping claw in a first position.
Figure 4:
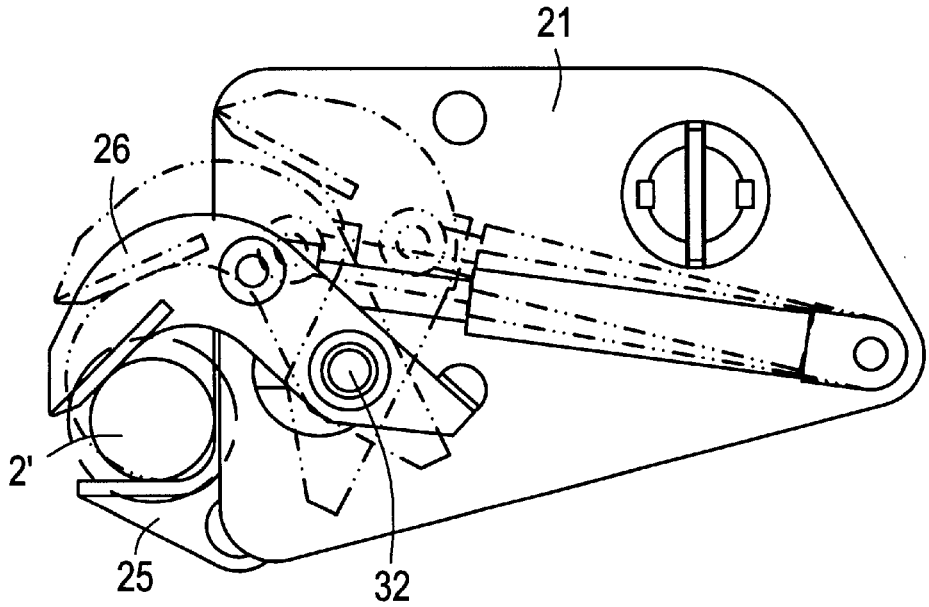
FIG. 4 shows the claw part in a second position, in a view corresponding to FIG. 3.

In order to adapt the removal device 18 to different diameters of tubular drilling rod parts 2 and 2' (see FIGS. 3 and 4), the upper claw part 26 is rotatably mounted on a pin 32, which is attached to the arm 21 and adjustable so that the gripping diameter of the two claw parts 25 and 26 can be set in their gripping positions shown in FIGS. 3 and 4. According to the example of embodiment shown, the pin 32 is designed eccentrically to an axis of rotation 33 of a bearing disk 34 rotatably mounted in the arm 21. By twisting the bearing disk 34, the pin 32 can be brought into any desired positions on a circular path about the axis of rotation 33, FIGS. 3 and 4 showing two positions, offset by 180°, for a large and a small diameter, respectively. In order to lock the bearing disk 34, a clamping device (not shown) which can be actuated by a screw 35 is provided. Instead of the eccentric adjustment mechanism shown, the pin 32 may also, for example, be attached to a vertically displaceable and adjustable rail of a linear adjustment, and in both cases setting aids such as markings or latching positions can facilitate the adjustment.

A confirmation device 36 moving the upper claw part 26 may be, for example, a hydraulic piston-and-cylinder unit, which is fixed at articulation points 37 and 38 to the claw part 26 and the arm 21, respectively. The lower claw 25 may be fixedly attached to the arm 21 or may also be movable via an actuating device (not shown).

What is claimed is:

1. A magazine and manipulation apparatus for drilling rod parts for a drill, said apparatus having a rod magazine in which one or more drilling rod parts are received in a multi-layered arrangement in a store, and having a removal device for transferring individual drilling rod parts from the rod magazine into a charging device which transports the drilling rod parts to the drill and for returning the drilling rod parts from the charging device to the rod magazine, the removal device being movably guided vertically and relative to the rod magazine on a guide and being capable of adjustment by vertical displacement to the current, position-dependent position of transfer in the rod magazine and to the charging device, wherein the removal device possess a pivot mechanism having at least one gripping and clamping unit for the clamping pick-up of a drilling rod part and wherein, by pivoting of the pivot mechanism, the drilling rod part retained by clamping in the gripping and clamping unit is moved between the position of transfer in the rod magazine and the charging device.

2. The apparatus as claimed in claim 1, wherein the rod magazine possesses a frame with vertical posts defining the store, and one of the posts contains the vertical guide for the removal device.

3. The apparatus as claimed in claim 1, wherein, by means of a movement device the drilling rod part or one of the drilling rod parts mounted in the store can be brought into its position of transfer and out of that position of transfer into a release position in the store.

4. The apparatus as claimed in claim 2, wherein each drilling rod part rests, in its position of transfer, on a post adjacent to the removal device.

5. The apparatus as claimed in claim 2, wherein a movement device possesses a pivotable support for a lower layer of the drilling rod parts which is arranged at the bottom of the frame and mounted to pivot about a longitudinal axis of the rod magazine.

6. The apparatus as claimed in claim 2, wherein the posts possess vertical grooves for guidance of spacer beams which are inserted between layers of the drilling rod parts.

7. The apparatus as claimed in claim 6, wherein a pivotable support can be pivoted by a pivot device both in a horizontal orientation and in both pivoting directions.

8. The apparatus as claimed in claim 7, wherein the pivot device possesses at least one pressure medium cylinder which is arranged between the frame and the pivotable support.

9. The apparatus as claimed in claim 1, wherein the gripping unit is designed as a gripping claw for picking up drilling rod parts of different diameters.

10. The apparatus as claimed in claim 1, wherein the gripping unit is attached to an arm of the pivot mechanism which can be pivoted about a longitudinal axis.

11. The apparatus as claimed in claim 9, wherein the gripping claw possesses an upper and a lower claw part, and a pin is positionally adjustable for a pivoted mounting of one claw part.

12. The apparatus as claimed in claim 11, wherein the pivot mechanism of the removal device possesses at least two gripping units which are spaced in the longitudinal direction.

13. The apparatus as claimed in claim 1, wherein said magazine and manipulation apparatus is attached to a rod trolley.

14. The apparatus as claimed in claim 13, wherein the rod trolley is designed as a drill trolley with a drill.

* * * * *